US010408476B2

(12) United States Patent
Ekolind et al.

(10) Patent No.: US 10,408,476 B2
(45) Date of Patent: Sep. 10, 2019

(54) AIR SUPPLY SYSTEM

(71) Applicant: Avidicare AB, Lund (SE)

(72) Inventors: Peter Ekolind, Ängelholm (SE); Henrik Skredsvik, Ängelholm (SE)

(73) Assignee: Avidicare AB, Lund (SE)

( * ) Notice: Subject to any disclaimer, the term of this patent is extended or adjusted under 35 U.S.C. 154(b) by 80 days.

(21) Appl. No.: 15/100,974

(22) PCT Filed: Dec. 2, 2014

(86) PCT No.: PCT/EP2014/076286
§ 371 (c)(1),
(2) Date: Jun. 1, 2016

(87) PCT Pub. No.: WO2015/082487
PCT Pub. Date: Jun. 11, 2015

(65) Prior Publication Data

US 2016/0298864 A1 Oct. 13, 2016

(30) Foreign Application Priority Data

Dec. 3, 2013 (EP) ..... 13195439

(51) Int. Cl.
*A61G 13/10* (2006.01)
*F24F 3/16* (2006.01)
(Continued)

(52) U.S. Cl.
CPC ..... *F24F 3/1607* (2013.01); *A61G 13/108* (2013.01); *F24F 9/00* (2013.01);
(Continued)

(58) Field of Classification Search
CPC ..... F24F 3/1607; F24F 9/00; F24F 11/0012; F24F 13/082; F24F 2003/1614; F24F 2013/088; F24F 2221/14; A61G 13/108
(Continued)

(56) References Cited

U.S. PATENT DOCUMENTS 4,009,647 A 3/1977 Howorth
5,830,058 A 11/1998 Røsjø
(Continued)

FOREIGN PATENT DOCUMENTS

CN 101420928 A 4/2009
CN 102264332 A 11/2011
(Continued)

OTHER PUBLICATIONS

Extended European Search Report dated Apr. 30, 2014, issued in corresponding Application No. EP13195439.8, filed Dec. 2, 2014, 6 pages.

(Continued)

*Primary Examiner* — Vivek K Shirsat
*Assistant Examiner* — Ryan L Faulkner
(74) *Attorney, Agent, or Firm* — Christensen O'Connor Johnson Kindness PLLC

(57) ABSTRACT

An air supply system (200, 300) for providing a clean air flow (250) in a room (1) is provided. The air supply system (200, 300) comprises a first air supply section (120) through which a first flow of clean air is supplied with a lower temperature than the temperature of the ambient air in the room (1), and a second air supply section (230) through which a second flow of clean air is supplied. The first air supply section (120) is arranged to form a gravitationally induced downward flow, whereas the second air supply section (230) is arranged to adjust the velocity (vi) of the second flow of clean air when entering the second air supply section (230) to a predetermined velocity (v2), and is adapted to direct the second flow of clean air downwards. A method (600) for providing a clean air flow in a room is further provided.

14 Claims, 5 Drawing Sheets

(51) Int. Cl.

| | |
|---|---|
| ***F24F 9/00*** | (2006.01) |
| ***F24F 13/08*** | (2006.01) |
| ***F24F 11/30*** | (2018.01) |
| *F24F 110/10* | (2018.01) |

(52) U.S. Cl.
CPC ..... *F24F 11/30* (2018.01); *F24F 13/082* (2013.01); *F24F 2003/1614* (2013.01); *F24F 2013/088* (2013.01); *F24F 2110/10* (2018.01); *F24F 2221/14* (2013.01)

(58) Field of Classification Search
USPC ..... 454/187
See application file for complete search history.

(56) References Cited

U.S. PATENT DOCUMENTS

| | | | | |
|---|---|---|---|---|
| 7,297,050 | B2 * | 11/2007 | Bridenne | F24F 3/1607 454/187 |
| 2010/0120349 | A1 * | 5/2010 | Kristensson | A61G 13/108 454/187 |
| 2010/0291859 | A1 * | 11/2010 | Kristensson | A61G 13/108 454/284 |

FOREIGN PATENT DOCUMENTS

| | | | |
|---|---|---|---|
| CN | 102667351 | A | 9/2012 |
| GB | 1 555 564 | | 11/1979 |
| JP | 2011-226770 | A | 11/2011 |
| WO | 2005/017419 | A1 | 2/2005 |
| WO | 2008/136740 | A1 | 11/2008 |

OTHER PUBLICATIONS

International Search Report dated Feb. 4, 2015, issued in corresponding International Application No. PCT/EP2014/076286, filed Dec. 3, 2013, 4 pages.

Chinese Office Action and Search Report dated Jul. 3, 2018, issued in corresponding Chinese Application No. 201480065673.3, filed Dec. 2, 2014, 8 pages.

* cited by examiner

Prior art Fig. 1

Prior art Fig. 2

AIR SUPPLY SYSTEM

TECHNICAL FIELD

The present invention relates to an air supply system for providing clean air in a room, such as a clean room.

BACKGROUND

In a clean room, it is essential keep some or all of the air in the room clean. Depending on the intended activity in the clean room, different levels of air cleanliness are required. In order to counteract contamination during activity in the room, such as surgery or production requiring a clean environment, it is of importance to reduce the number of airborne particles such as dust particles or bacteria-carrying particles, the latter also referred to as colony forming units (cfu).

The contamination level in a room may be defined in different ways. One example of a definition is the concentration of particles of a particular size. Some DIN (Deutsches Insitut für Normung) standards use this definition for defining a degree of protection for different clean rooms. For example, the maximum allowed degree of protection may be set to 3 500 particles/$m^3$ for particles with a size up to 0.5 μm. Another example of a definition is the concentration of airborne bacteria carrying particles per volume. For example, the maximum allowed contamination level in a clean room may be defined as 100 cfu/$m^3$.

Clean air may be provided using air supply systems providing turbulent air flows. One benefit of using a turbulent air flow is that the air present in the room comprising air borne particles is mixed with supplied clean air such that the present air is diluted. The contamination level of the room is thereby reduced.

For clean rooms requiring a higher level of cleanliness, such as high end production clean rooms or operating theatres for high infection sensitive surgery, the cleanliness requirements are much harder.

It should be noted that an air supply system arranged to provide a turbulent air flow in a room needs to achieve very high air flows, in the range of hundreds air exchange rates, to maintain such required low level of air borne particles. As a result, the provided clean room environment is not work friendly. To achieve a more work friendly environment and to reduce the amount of supplied clean air supply systems for providing laminar air flows are preferably used instead of air supply systems for providing on turbulent air flows. By using air supply systems based on laminar air flows, it is possible to keep the contamination level of the covered area low without the need for very high air flows.

U.S. Pat. No. 4,009,647 discloses an example of an apparatus for providing a clean air zone around a patient undergoing surgery. The apparatus comprises a plurality of air delivery means being adapted to supply air at different velocities.

WO 2008/136740 discloses a ventilating device for providing a zone of clean air between the ventilating device and a workplace region. The ventilating device comprises air supply units adapted to generate laminar air flows intended to constitute the clean air zone.

There is, however, a need to improve air supply systems for supplying clean air flows in a room.

SUMMARY OF THE INVENTION

An object of the present invention is to provide an improved air supply system for supplying a clean air flow in a room. A further object is to provide an improved method for providing a clean air flow in a room.

According to a first aspect of the present invention, an air supply system for providing a clean air flow in a room is provided. The air supply system comprises a first air supply section through which a first flow of clean air is supplied with a lower temperature than the temperature of the ambient air in the room, a second air supply section through which a second flow of clean air is supplied, wherein the first air supply section is arranged to brake the initial velocity of the first flow of clean air when entering the first air supply section, whereby the first flow of clean air thereafter forms a gravitationally induced downward flow, wherein the second air supply section is arranged to adjust the velocity of the second flow of clean air when entering the second air supply section to a predetermined velocity, and adapted to direct the second flow of clean air downwards, and wherein the first air supply section and the second air supply section are situated in the ceiling in the room, the first air supply section at least partly surrounding the second air supply section.

The first air supply section supplies clean air with a temperature being lower than the temperature of the ambient air in the room. Clean air is thereby supplied which has a higher density than that of the ambient air. By using the air density difference and by further braking the initial velocity of the first flow of clean air the supplied air sinks downwards by essentially only gravitational forces. As a result a laminar flow of air directed downwards from the ceiling is obtained by the first air supply section.

By laminar flow of air is meant a uni-directional air flow which has substantially the same direction within a volume of the laminar air flow. The laminar air flow may have the purpose of displacing air borne particles in an air zone covered by the laminar air flow. Without falling outside the scope of the present invention, it is to be understood that the laminar air flow due to for example surrounding disturbances may deviate from an exact uniform direction while still fulfilling its purpose of displacing air borne particles.

By combining the first flow of clean air supplied by the first air supply section and the second flow of clean air supplied by the second air supply section, an improved clean laminar air flow with regards to flow stability and uniformity is provided. In particular, it has been realized that the risk of formation of low-pressure air zones in the clean laminar air flow is decreased. By low-pressure air zones is meant that the air within these zones have a lower pressure than the surrounding air.

The risk of entrainment of small-sized particles into the laminar flow, due to the low-pressure air zones, is thereby decreased. By the inventive system, some standardized tests, such as DIN 1946-4 qualification test for operating rooms, may be fulfilled. This test measures for example the entrainment of small-sized particles with a size up to 0.5 μm into the laminar air flow.

The second air supply section supplies air by a different principle than the first air supply section. The second air supply section is arranged such that an air flow with a predetermined velocity and direction is supplied. By combining the first and the second flows of clean air the risk of formation of low-pressure air zones in the clean air flow is mitigated and an improved clean air flow is provided in the room.

The inventive combination of the first air supply device and the second air supply device provides for an area, such as a work area, in the room with a cleanliness which may keep high cleanliness. By work area is meant an area of the clean room where the activity is intended to be performed.

The predetermined velocity may be selected such that the clean air flow has essentially the same velocity throughout a cross-section, as seen transverse the downward direction, of the clean air flow at a specific level. This feature improves the supplied clean air flow in the room as turbulence within the air flow is mitigated. A laminar flow of air may thereby be obtained. The wording specific level should be construed as the level at which the main activity in the clean room is conducted. In an operation theatre the specific level may for instance be the level of an operating table located in the work area of the room.

The second flow of clean air may have the same temperature as the first flow of clean air. This feature further improves the laminar flow of the supplied clean air flow in the room as differences in the density of the air in the supplied clean air is reduced. The risk of turbulence within the air flow and the formation of low-pressure air zones are thereby mitigated.

The second air supply section may comprise air outlets formed in an air supply membrane. A homogeneous air flow is thereby provided.

The air outlets in the air supply membrane may be formed as a honeycomb structure. This is advantageous as the honeycomb structure provides a homogeneous and directed air flow.

The first air supply section may comprise at least one air supply membrane formed by an air permeable body having an inner body and an outer body, wherein the first flow of clean air is supplied in a direction from the inner body to the outer body.

The inner body may be arranged to brake the first flow of clean air. The inner body may reduce the velocity of the first flow of clean air such that the clean air after leaving the first air supply section may, by means of gravity, be transported to the work area. The outer body may be arranged to direct the first flow of clean air to the work area. Hence the first air supply section provides a homogenous laminar flow of clan air for which air turbulence is reduced.

The first air supply section may comprise a plurality of air supply membranes, and wherein air spoilers are disposed between each pair of mutually adjacent air supply membranes of the first air supply section.

The presence of air spoilers is advantageous as surrounding air is prevented or at least hindered to be drawn into the clean air provided by the air supply system. The air spoilers may due to their shape further help to minimize the increased downward velocity which may occur when clean air provided by adjacent first air supply membranes met in an uncontrolled manner. Hence the risk of the formation of low-pressure air zones are further mitigated.

The first air supply section may be ring-shaped and surround the second air supply section. The wording ring-shaped should be construed as a ring shape formed by one or a plurality of segments providing a continuous or discontinuous ring.

According to a second aspect of the invention, the above mentioned and other objects may be achieved by a method for providing a clean air flow in a room. The method comprises:

supplying a first flow of clean air through a first air supply section, the first flow of clean air having a lower temperature than the temperature of the ambient air in the room, braking, by the first air supply section, the initial velocity of the first flow of clean air when entering the first air supply section, whereby the first flow of clean air thereafter forms a gravitationally induced downward flow;

supplying a second flow of clean air through a second air supply section, adjusting, by the second air supply section, the velocity of the second flow of clean air when entering the second air supply section to a predetermined velocity, and directing, by the second air supply section, the second flow of clean air downwards, wherein the first air supply section and the second air supply section are situated in the ceiling in the room, the first air supply section at least partly surrounding the second air supply section.

All of some of the steps may be performed parallel to each other.

The above disclosed features and corresponding advantages of the first aspect is also applicable to this second aspect. To avoid undue repetition, reference is made to the discussion above.

It is noted that the invention relates to all possible combinations of features recited in the claims.

BRIEF DESCRIPTION OF THE DRAWINGS

This and other aspects of the present invention will now be described in more detail, with reference to the enclosed drawings showing embodiments of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein. These embodiments are rather provided for thoroughness and completeness, and for fully conveying the scope of the invention to the skilled person.

Figure 1:
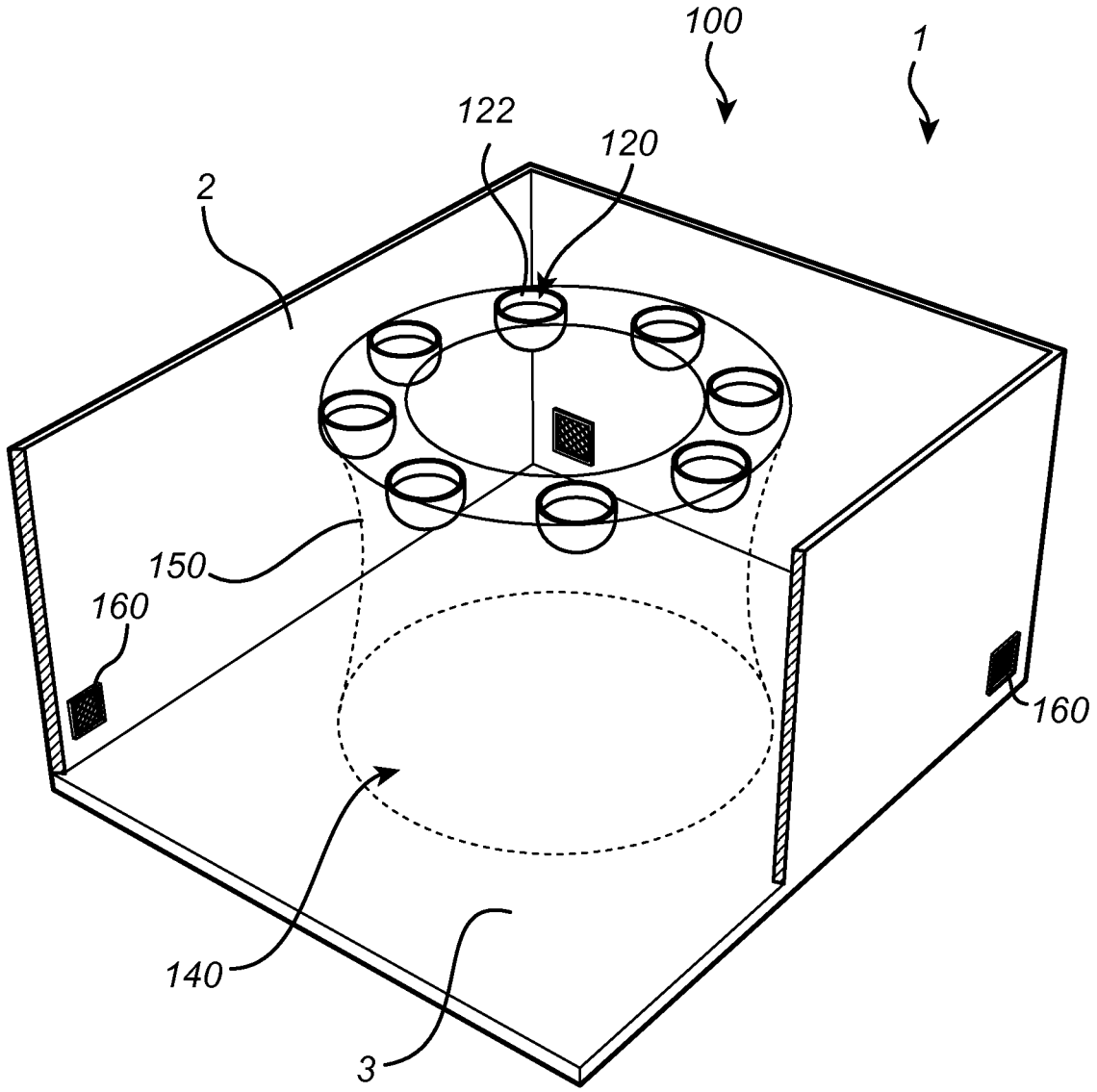
FIG. 1 illustrates a clean room comprising an air supply system of known type.
Figure 2:
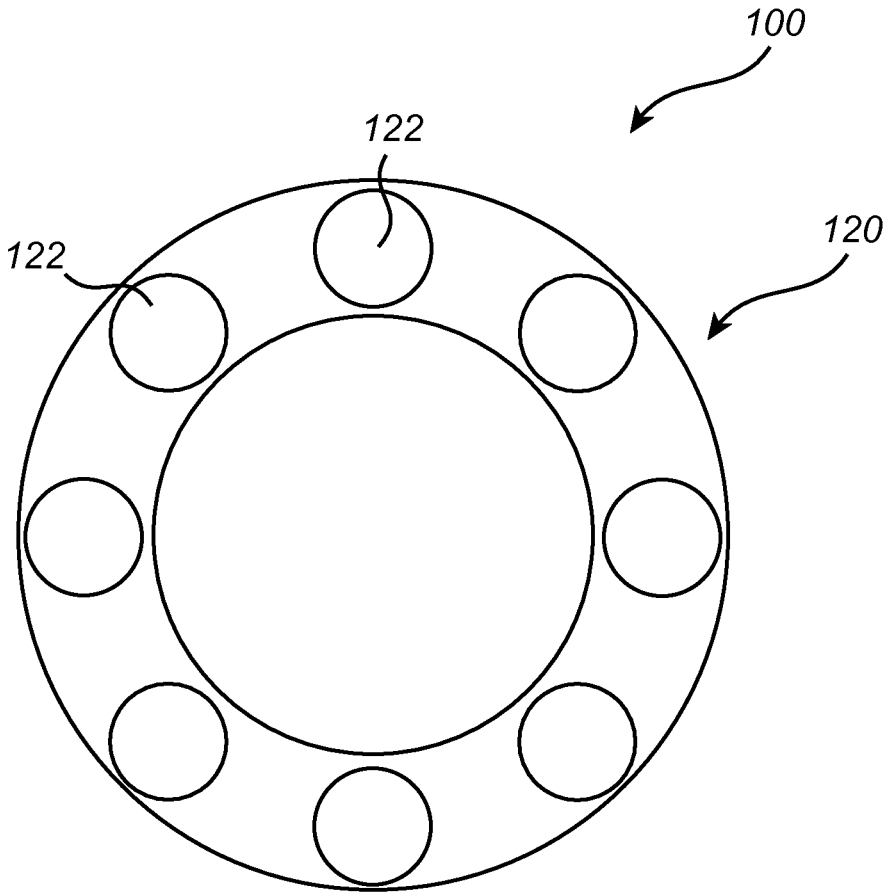
FIG. 2 is a view from below of an air supply system of known type.

FIG. 1 illustrates a clean room 1 comprising an air supply system 100 of known type. FIG. 2 is a view from below of the same air supply system 100.

The air supply system 100 comprises an air supply section 120 which is arranged in a ceiling 2 of the clean room 1. The air supply section 120 is arranged above an intended work area 140 of the clean room 1. The clean room 1 could be e.g. an operating theatre, a production room for clean products, or a room for handing sterile products, such as unpacking and preparation of sterile instruments before an operation.

The air supply section 120 comprises a plurality of air supply membranes 122 which are arranged in an octagonal pattern.

The air supply section 120 supplies clean air with a temperature being lower than the temperature of the ambient air in the room 1. Clean air is thereby supplied having a higher density than that of the ambient air. By this air density difference the supplied air sinks downwards by essentially only gravitational forces. As a result a laminar air flow 150 directed downwards from the ceiling 2 is supplied by the air supply section 120. The laminar characteristic of the air flow 150 is advantageous in that clean air is provided without the need for very high air flows.

Air discharge units 160 are arranged in the clean room 1. These air discharge units 160 are located in the side wall of the clean room 1, preferably near the corners in side walls, and at a level of about 10 cm above the level of a floor 170 of the clean room 1. The air discharge units 160 are adapted to, actively or passively, guide air out from the clean room 1.

Each of the air supply membranes 122 is formed by an air permeable body having an inner body and an outer body (not shown). The laminar air flow 150 is thereby provided by supplying a flow of clean air through the air supply membrane 122 in a direction from the inner body to the outer body.

The inner body of the air supply membrane 122 is arranged to brake the first flow of clean air whereas the outer body is arranged to subsequently direct the first flow of clean air such that a gravitationally induced downward flow is created.

WO 2005/017419 discloses an example of how the air supply membrane 122 may be designed. The document discloses that the inner body of the air permeable body of the air supply membrane 122 consists of, or includes, porous material. The inner body is further designed to provide resistance when air is supplied there through. The inner body may have filtering properties in order to provide fewer air borne particles that exit the air supply membrane 122. The porous material may be foamed plastic with preferable open cells. The outer part of the air permeable body of the air supply membrane 122 may comprise air passages. The outer part may be non-porous and may have portions forming or defining passages or channels of uniform or substantially uniform thickness located close to each other. The channels may be rectilinear or substantially rectilinear and extend in parallel or substantially in parallel to each other. By means of design of the passages, good directional effect and generation of rectilinear air flows are provided.

Figure 3:
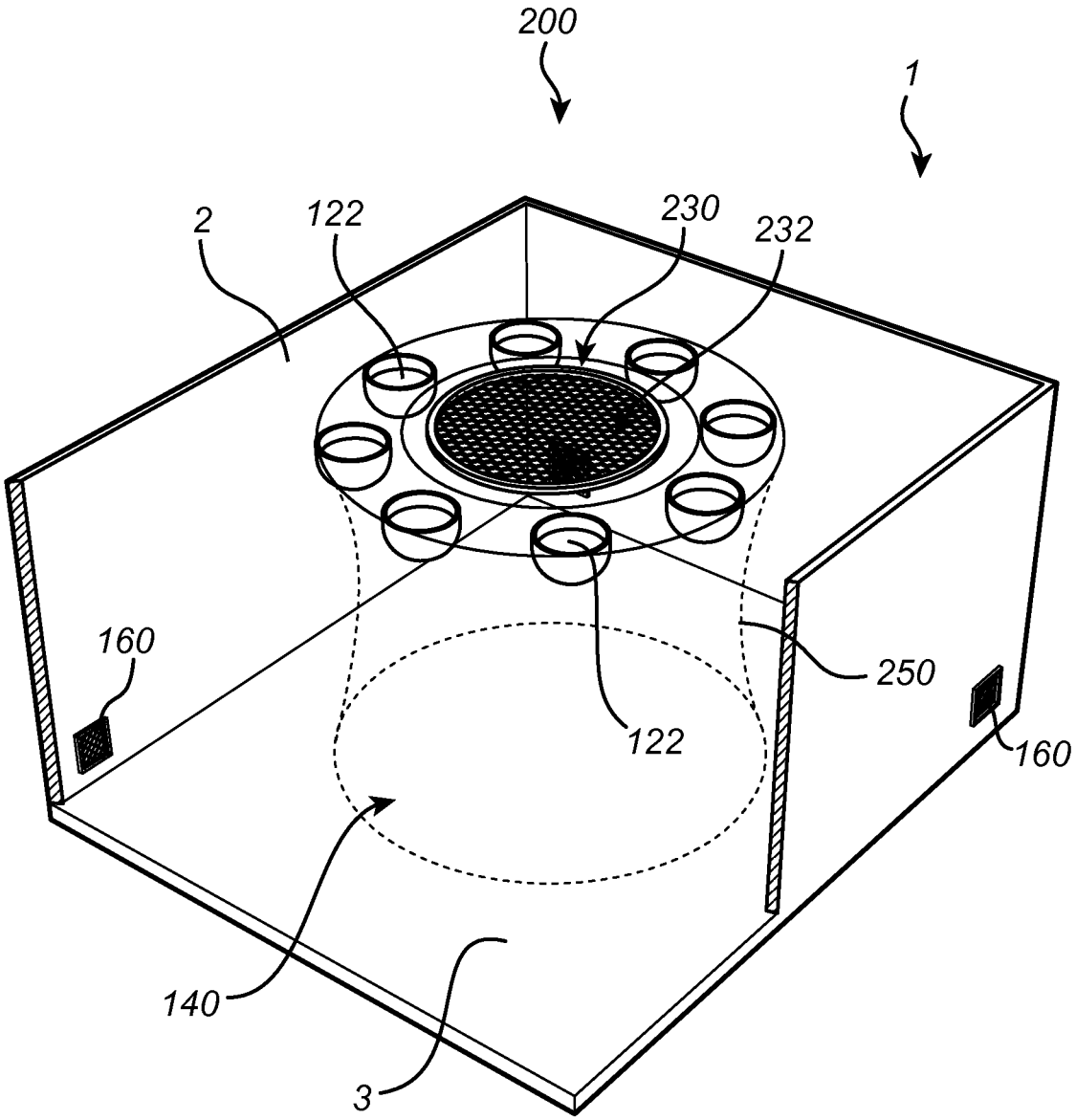
FIG. 3 illustrates a clean room comprising an air supply system according to an embodiment of the present invention.

An air supply system 200 according to one embodiment of the present invention will now be described in detail. FIG. 3 illustrates such an air supply system 200 where a first air supply section 120 and a second air supply section 230 are situated in the ceiling 2 of the clean room 1.

The first air supply section 120 corresponds to the air supply section 120 of FIGS. 1 and 2, but when describing embodiments of the invention it will be denoted "first" in order to distinguish it from the additional second air supply section 230.

The first air supply section 120 discloses first air supply membranes 122, as previously described in connection to FIGS. 1 and 2. A first flow of clean air is supplied through the air supply membranes 122 of the first air supply section 120.

The second air supply section 230 comprises a second air supply membrane 232 through which a second flow of clean air is supplied. The second air supply section 230 is arranged to adjust the velocity of the second flow of clean air when entering the second air supply section 230. The velocity is adjusted to a predetermined velocity. The second air supply section 230 is also adapted to direct the second flow of clean air downwards.

By combining the first flow of clean air supplied by the first air supply section 120 and the second flow of clean air supplied by the second air supply section 230, an improved clean laminar air flow 250 with regards to flow stability and uniformity is provided. In particular, it has been realized that the risk of formation of low-pressure air zones in the clean laminar air flow 250 is decreased. By low-pressure air zones is meant that the air within these zones have a lower pressure than the surrounding air. The surrounding air may be the supplied clean air and/or the ambient air in the room.

The risk of entrainment of small-sized particles into the laminar flow, due to the low-pressure air zones, is thereby decreased. By the inventive system, some standardized tests, such as DIN 1946-4 qualification test for operating rooms, may be fulfilled. This test measures for example the entrainment of small-sized particles with a size up to 0.5 μm into the laminar air flow.

Depending on the temperature of the clean air and the ambient air, how the air outlets are arranged etc., the predetermined velocity of the second flow of clean air may differ. For a specific air supply system configuration, the appropriate predetermined velocity may be determined by testing and/or simulating the air flow velocities and adjusting parameters of the air supply system, such as initial velocity when entering the air supply sections and/or the design of the air supply sections, until a desired air flow at e.g. a specific level is achieved. The predetermined velocity is preferably set such that an air velocity of about 0.25 m/s is obtained when the air reaches, for instance, a certain working height in the clean room 1.

The working height should in this context be understood as the height, as measured from the floor 170 of the clean room 1, where the activity in need of clean air is primarily conducted.

The velocity of the second flow of clean air may preferably be measured, by e.g. an air flow speed meter, at a distance of about 10 centimeters below the first air supply membrane 122 in the direction of the clean air flow 250, in order to ensure that the air velocity has the desired predetermined value.

Figure 4:
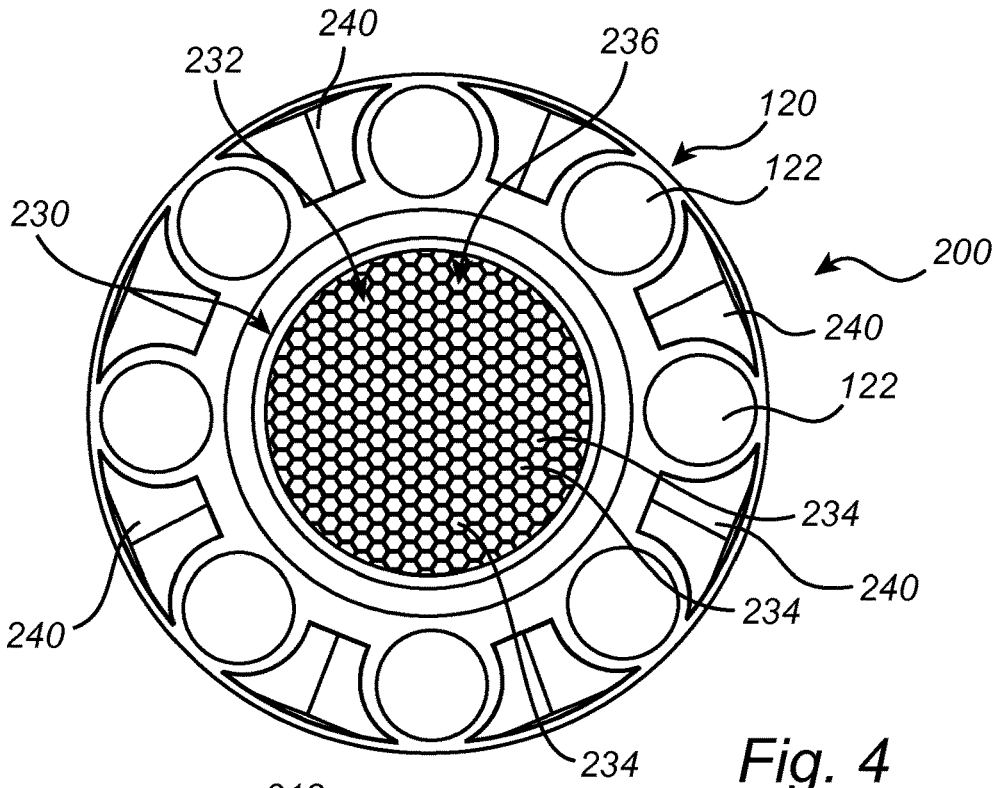
FIG. 4 is a view from below of an air supply system according to an embodiment of the present invention.

One embodiment of the second air supply section 230 will now be disclosed with reference to FIG. 4. FIG. 4 is a view from below of the air supply system 200 disclosed in FIG. 3. As illustrated in FIG. 3, the first air supply section 120 comprises a plurality of first air supply membranes 122. In this embodiment, the air supply membranes 122 are arranged in an octagonal pattern. The first air supply section 230 is ring-shaped and surrounds the second air supply section 230. The wording ring-shaped should be construed as a ring shape formed by one or a plurality of segments providing a continuous or discontinuous ring.

For symmetry reasons, the second air supply section 230 is arranged in the centre of the octagonal pattern. The flow of clean air 250 thereby becomes more homogeneous.

The inventive combination of the first air supply section 120 and the second air supply section 230 provides clean air in an area, such as a work area 140, in the clean room 1. The clean air flow 250 is provided between the first and second air supply sections 120, 230 and the work area 140 in the clean room 1.

The second air supply section 230 typically uses larger volumes of air than the first air supply section 120, which implies that more energy is needed to supply the clean air from the second air supply section 230. By arranging the first air supply section 120 such that it surrounds the second air supply section 230 the size of the second air supply section may be kept relatively small without reducing the area of the clean room for which clean air is supplied. In other words, clean air may be provided over a larger area of the clean room 1 in an more energy efficient manner. To provide a homogeneous and directed air flow the second air supply section 230 comprises air outlets 234 formed in the second air supply membrane 232. The air outlets 234 are formed as a honeycomb structure 236. This structure may also be referred to as having openings in a hexagonal shaped pattern or grid. The honeycomb structure 236 is a mechanically stabile structure.

It should be noted that the second air supply membrane 232 may in other embodiments comprise a perforated layer in which the air outlets may be arranged in any arrangement or pattern by which a homogeneous laminar air flow 250 is provided by the air supply membrane 232.

The air supply system 200 may be arranged such that the provided clean air flow 250 has an extension, as seen in a horizontal plane that covers an area having e.g. a circular, rectangular or oval shape. Other shapes are of course also feasible. In preferred embodiments, the covered area is in the interval of 0.5-16 $m^2$. In case of a circular shape, the air supply system 200 may be arranged such that the extent of the clean air flow, as seen in a horizontal plane, covers a circular area extending with a radius of 0.5-2 meters, preferably 0.75-1.5 meters, as seen from the centre of the work area 140.

An area extending with a radius of 0.5-2 meters as seen from the centre of the work area 140, yields an area of about 0.75 to 13 $m^2$. An area extending with a radius of 0.75-1.5 meters as seen from the centre of the work area 140, yields an area of 1.7 to 7.1 $m^2$.

In applications where it is desired that the supplied air flow 250 covers a larger area, the first air supply section 120, as illustrated in FIG. 4, may comprise an additional ring-shaped section (not shown) of air supply membranes 122. The additional section may be located such that is surrounds the illustrated air supply section 120. The air supply membranes of the additional section are configured in the same manner as the air supply membranes 122 of the illustrated air supply section 120. It is realized that yet further additional sections are possible depending on the desired cover area of the supplied laminar air flow 250.

According to one embodiment of the present invention the air supply system 200 is provided in a room being an operating theatre. In an operating theatre, an operating table (not illustrated) is typically arranged in the work area 140. As an alternative example, the air supply system 200 may be provided in a production room. In a production room, a production station (not illustrated) is typically located in the work area 140. The work area 140 may extend to an area surrounding e.g. the operating table or production station, in which area staff and equipment may be present.

According to one embodiment of the present invention where the first air supply section 120 comprises a plurality of air supply membranes 122, air spoilers 240 are disposed between each pair of mutually adjacent first air supply membranes 122. The first air supply section 120 may thereby be arranged as a discontinuous structure surrounding the second air supply section 230. This facilitates easy assembly and exchange of the first air supply membranes 122.

The presence of air spoilers 240 is advantageous as ambient air is prevented or at least hindered to be drawn into the clean air flow 250 provided by the air supply system 200. Each spoiler 240 is formed as a ridge which extends in a direction outwards from the inner area of the air supply section 120. The air spoilers 240 may due to their shape further help to minimize the increased downward velocity which may occur when clean air provided by adjacent first air supply membranes 122 meet in an uncontrolled manner. Hence, the risk of low-pressure air zones in the clean air flow 250 is further decreased.

It should be noted that the laminar air flow 250 has a substantially uniform direction, in contrary to turbulent flows. However, due to disturbances in the flow path, such as persons or equipment, the direction of the laminar air flow 250 will increasingly turn outwards from the centre of the laminar air flow volume with an increasing distance from respective air supply sections 120, 230. Thus, the clean air flow 250 provided gets a funnel-shaped form in the room.

Figure 5:
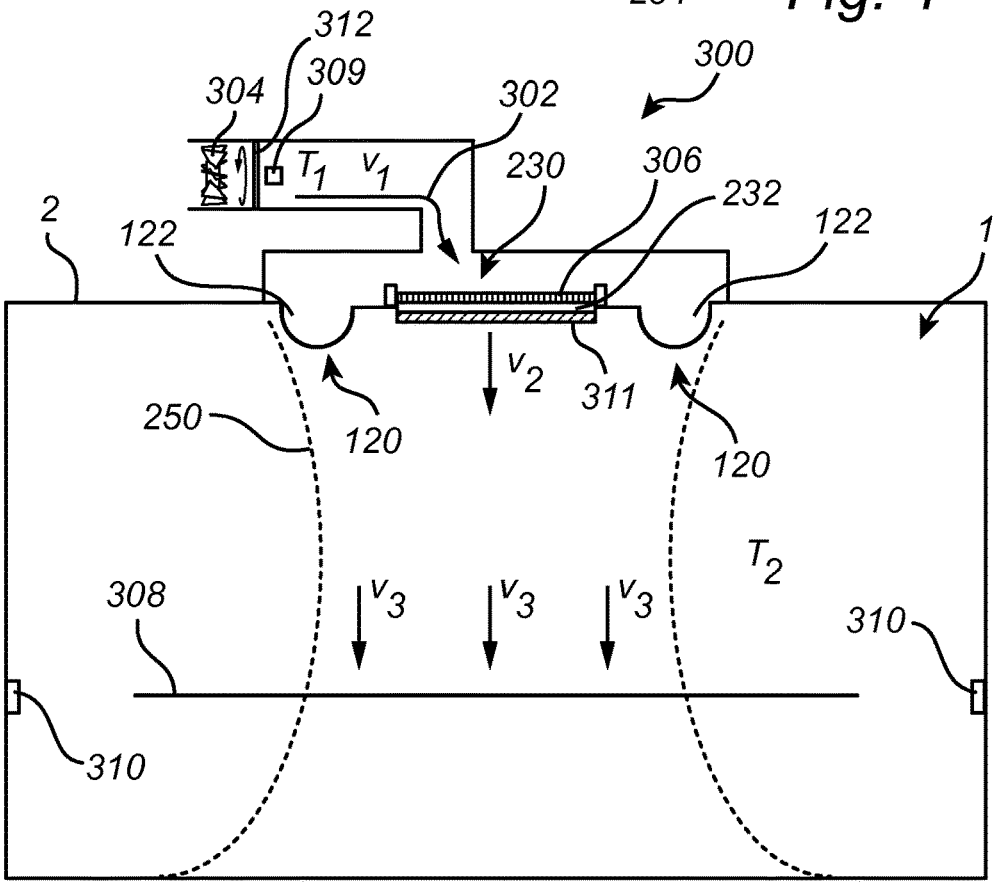
FIG. 5 illustrates a clean room comprising an air supply system according to an embodiment of the present invention.

The following will disclose an example of how an air supply system 300 according to an embodiment of the present invention may function. FIG. 5 illustrates a cross-sectional view of the clean room 1 comprising the air supply system 300. The first air supply section 120 and the second air supply section 230 are situated in the ceiling 2 of the clean room 1.

The first air supply section 120 and the second air supply section 230 are supplied with a common flow of clean air 302. The common flow of clean air 302 is in this embodiment provided by a common air flow source (not shown). The air flow source may comprise an air intake outside the room and/or a circulation device for circulating the air discharged by the air dischargers 160. By supplying the common air flow 302 to the air supply sections 120, 230, the number of components needed for the installation of the air supply device 300 is reduced.

The common flow of clean air 302 is supplied using a fan 304. By providing the common flow of clean air 302, only one air flow need to be controlled in view of temperature and velocity. Thus, an efficient control system is provided. The person skilled in the art realises that the common flow of clean air 302 may be provided by other means than a fan 304.

A filter element 312, comprising for example a HEPA filter, is arranged in the channel of the common flow of clean air 302. The filter element 312 cleans the throughpassing air such that the provided air flow 302 is clean.

As disclosed in connection to FIG. 3 and FIG. 4, the first air supply section 120 supplies clean air with a temperature $T_1$ being lower than the temperature $T_2$ of the ambient air in the clean room 1. Clean air is thereby supplied which has a higher density than that of the ambient air. By using this air density difference and by further braking the initial velocity $v_1$ of the first flow of clean air as provided by the common flow of clean air 302, the supplied air sinks downwards by essentially only gravitational forces. As a result, a laminar air flow 250 directed downwards from the ceiling 2 is supplied by the first air supply section 120.

The wording braking should be understood as that the initial velocity $v_1$ of the first flow of clean air is reduced such that the velocity of the clean air leaving the first air supply membrane 122 is essentially zero at a distance below the first air supply membrane 122. The distance is typically in the range 10 cm to 15 cm, but depends for instance on the initial velocity $v_1$, the temperature difference between $T_1$ and $T_2$ and the structure of the first air supply membrane 122.

As an example, it is assumed that the velocity of the clean air is essentially zero at a distance of 10 cm below the first air supply membrane 122 and that the air flow 250 may be controlled to have a temperature $T_1$ of 1-2° C. lower than the temperature $T_2$ of the ambient air in the clean room 1. Under these assumptions, the laminar air flow 250 may achieve a velocity of 0.25 m/s when reaching a distance of 2 meters below the first air supply membrane 122 being situated in the ceiling. In a room having a ceiling height of about 3 meters, this is a typical working height (1 meter above the floor) used for the activities within the clean room 1. A velocity of around 0.25 m/s in the working height is advantageous since the velocity is high enough to brake the natural convection of particles deriving from persons being located in the area of the laminar air flow 250, however the velocity is still small enough to not cause any significant disturbances in form of discomfort or draught for the same persons.

As disclosed above, the second air supply section 230 comprises a second air supply membrane 232 through which a second flow of clean air is supplied. The second air supply section 230 is arranged to adjust the velocity $v_1$ of the common flow of clean air 302, as it has when entering the second air supply section 230, to a predetermined velocity $v_2$. The second air supply section 230 is also adapted to direct the second flow of clean air downwards. The predetermined velocity $v_2$ is selected such that the clean air flow 250 has essentially the same velocity $v_3$ throughout a cross-section 308, as seen transverse the downward direction, of the clean air flow 250 at a specific level. According to one embodiment of the present invention the same velocity $v_3$ is around 0.25 m/s when reaching a distance 2 meter, being the specific level, below the second air supply member 230. The specific level may be the working height, such as a product assembly station or an operating table, for activities in the work area 140 which the clean air flow 250 covers. The working height for manual work activities, such as at a production station or at an operating table, could for example be 1 meter above the floor level.

In this embodiment of the present invention the second flow of clean air has the same temperature $T_1$ as the first flow of clean air. This improves the laminar characteristics of the supplied clean air flow 250 in the room since differences in the density between the supplied clean air flows from the different air supply sections 120, 230 are reduced. Thus, the risk of turbulence in the air flow 250 associated with temperature, and thereby pressure differences, within the supplied clean air is mitigated. The pressure differences may otherwise lead to the presence of low or high pressure air zones within the formed clean air flow 250.

The air supply system 300 further comprises a temperature controller 309. In this embodiment, the temperature controller 309 is located in the channel through which the common flow of clean air 302 is supplied to the air supply system 300. The temperature controller 309, being for example a heating radiator, a cooling radiator or a hot or cold air outlet, adjusts the temperature $T_1$ of the common flow of air 302 to a desired value. As exemplified above, it may be desired to adjust the temperature $T_1$ to 1-2° C. below the temperature $T_2$ of the ambient air. For this purpose, temperature sensors 310 are located in the ambient air outside the clean air flow 250. The temperature controller 309 receives the air temperature values measured by the temperature sensors 310 and adjust the temperature of the common flow of clean air 302 accordingly.

The second air supply section 230 comprises a protective layer 311. The protective layer 311 cover the honeycomb structure of the air supply section 232, which thereby is protected from being damaged or becoming dirty by for instance activities performed in the clean room 1. The protective layer 311 is preferably easily exchangeable.

The second air supply section 230 further comprises an inner air permeable layer 306. The inner air permeable layer 306 may consist of, or included porous material such that, by providing an even air flow resistance, the velocity of the air in the air flow is reduced. By selecting the velocity $v_1$ of the air flow 302 entering the air permeable layer and/or changing the resistance of the permeable layer 306, the velocity $v_1$ may be adjusted to a predetermined value for the air velocity $v_2$. The air resistance may for instance be varied by changing the porosity of the air permeable layer.

The air supplied through the second air supply section 230 is moreover distributed i.e. equalized in pressure by being transported through the inner air permeable layer 306. The porous material may be foamed plastic, preferably with open cells.

Figure 6:
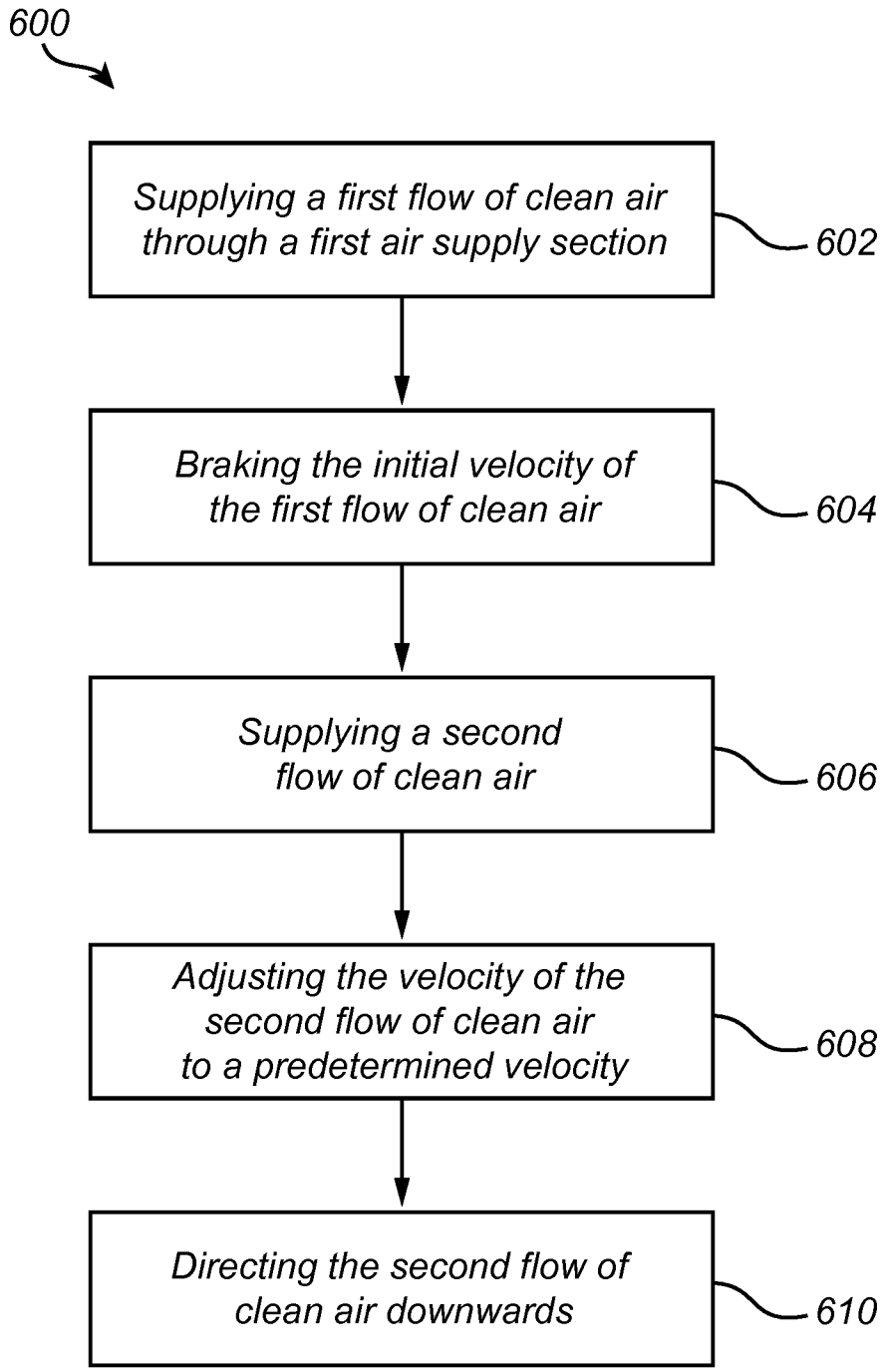
FIG. 6 illustrates a method for providing a clean air flow in a room according to an embodiment of the present invention.

A method 600 for providing a clean air flow in a room is illustrated in FIG. 6. The method comprises supplying 602 a first flow of clean air having a lower temperature than the temperature of the ambient air in the room. The first flow of clean air is provided through a first air supply section. The method also comprises braking 604, by the first air supply section, the initial velocity of the first flow of clean air when entering the first air supply section. By the method the first flow of clean air thereafter forms a gravitationally induced downward flow. The method further comprises supplying 606 a second flow of clean air through a second air supply section. The velocity of the second flow of clean air is adjusted 608, by the second air supply section, when entering the second air supply section to a predetermined velocity. The method further comprises directing 610, by the second air supply section, the second flow of clean air downwards. The first air supply section and the second air supply section are according to the method situated in the ceiling in the room and the first air supply section at least partly surrounding the second air supply section.

In one embodiment, the steps of supplying 602 the first flow of clean air and supplying the second flow of clean 604 air are performed parallel to each other.

Features of the steps have been disclosed in connection to the previous figures and apply also to the method, where applicable.

The person skilled in the art realizes that the present invention by no means is limited to the preferred embodiments described above. On the contrary, many modifications and variations are possible within the scope of the appended claims.

For example, the second air supply section may comprise a plurality of air supply membranes.

As another example, the first air supply section may only partly surround the second air supply device. This may be advantageous in some applications by that the size of the air supply system is reduced. The first air supply section may for example be shaped as a horseshoe partly surrounding the second air supply section.

On the other hand, the first air supply section may in other embodiments be ring-shaped and may surround the second air supply section. The ring may have any geometrical form, for instance circular or elliptical.

As yet another example, the air outlets in the one or more air supply membranes of the second air supply section may be formed in a pattern other than the honeycomb structure. The one or more air supply membranes of the second air supply section may comprise openings having any shape such as being triangular, quadratic, pentagonal etc. The openings may be arranged in order or in a random arrangement.

The plurality of first air supply membranes may be arranged in a pattern such as a triangle, rectangle, hexagon, or of any shape as long as the first air supply section partly or fully surrounds the second air supply section. As an alternative to the plurality of air supply membranes of the first air supply section, the first air supply section may comprise a single air supply membrane in the form of an air supply layer or sheet.

The first air supply section is not limited to comprising separately formed air supply membranes. On the contrary, the air supply section may comprise a single air supply membrane covering essentially the whole interface of the first air supply section towards the room.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An air supply system for providing a clean air flow in a room, the air supply system comprising:

a first air supply section through which a first flow of clean air is supplied with a lower temperature than the temperature of the ambient air in the room, a second air supply section through which a second flow of clean air is supplied, wherein the first air supply section is arranged to brake the initial velocity ($v_1$) of the first flow of clean air when entering the first air supply section, such that the initial velocity ($v_1$) of the first flow of clean air is reduced such that the velocity of the clean air leaving the first air supply section is essentially zero in a position below and at a vicinity of the first air supply section, whereby the first flow of clean air thereafter forms a gravitationally induced downward flow, wherein the second air supply section comprises an inner air permeable layer, said second air supply section being arranged to adjust, at least by adjusting the resistance of the inner air permeable layer, the velocity ($v_1$) of the second flow of clean air when entering the second air supply section to a predetermined velocity ($v_2$), and adapted to direct the second flow of clean air downwards, wherein the first flow of clean air and the second flow of clean air together make up a clean air flow, wherein the predetermined velocity ($v_2$) is selected such that the clean air flow has essentially the same velocity ($v_3$) throughout an entire cross-section of the clean air flow, as seen transverse the downward direction, of the clean air flow at a specific level, the specific level being a working height for activities in a work area of the room which the clean air flow covers, and wherein the first air supply section and the second air supply section are situated in the ceiling in the room, the first air supply section at least partly surrounding the second air supply section.

2. The air supply system according to claim 1, wherein the second flow of clean air has the same temperature as the first flow of clean air.

3. The air supply system according to claim 1, wherein the second air supply section comprises air outlets formed in an air supply membrane.

4. The air supply system according to claim 3, wherein the air outlets in the air supply membrane are formed as a honeycomb structure.

5. The air supply system according to claim 1, wherein the first air supply section comprises at least one air supply membrane formed by an air permeable body.

6. The air supply system according to claim 5, wherein the first air supply section comprises a plurality of air supply membranes, and wherein air spoilers are disposed between each pair of mutually adjacent air supply membranes of the first air supply section.

7. The air supply system according to claim 1, further comprising a temperature controller arranged to adjust the temperature of the clean air forming the first flow of clean air and/or the second flow of clean air, the adjustment being based on the temperature of the ambient air in the room as measured by one or more temperature sensors located in the ambient air in the room.

8. The air supply system according to claim 1, wherein the first air supply section is ring-shaped and surrounds the second air supply section.

9. The air supply system according to claim 1, wherein the clean air flow is provided between the first and second air supply sections and a work area in the room.

10. The air supply system according to claim 9, wherein the room is an operating theatre.

11. The air supply system according to claim 1, wherein the first air supply section and the second air supply section are supplied with a common flow of clean air, said common flow of clean air having an initial velocity ($v_1$) and temperature ($T_1$).

12. The air supply system according to claim 1, wherein the first air supply section comprises a plurality of air supply membranes, and wherein air spoilers are disposed between each pair of mutually adjacent air supply membranes of the first air supply section.

13. The air supply system according to claim 1, wherein the room is an operating theatre.

14. A method for providing a clean air flow in a room, the method comprising:

supplying a first flow of clean air through a first air supply section, the first flow of clean air having a lower temperature than the temperature of the ambient air in the room, braking, by the first air supply section, the initial velocity of the first flow of clean air when entering the first air supply section such that the initial velocity ($V_1$) of the first flow of clean air is reduced so the velocity of the clean air leaving the first air supply section is essentially zero at a position below the air supply section, whereby the first flow of clean air thereupon forms a gravitationally induced downward flow, supplying a second flow of clean air through a second air supply section, adjusting, at least by an inner permeable layer of the second air supply section, the velocity of the second flow of clean air when entering the second air supply section to a predetermined velocity ($V_2$), and directing, by the second air supply section, the second flow of clean air downwards to cooperatively constitute a clean air flow, wherein the clean air flow is the same velocity ($V_3$) horizontally across the entire clean air flow at the level of the working height of the activities of the room;

wherein the first air supply section and the second air supply section are situated in the ceiling in the room, the first air supply section at least partly surrounding the second air supply section.

* * * * *